US009140027B2

(12) United States Patent
Ramirez Magaña

(10) Patent No.: US 9,140,027 B2
(45) Date of Patent: Sep. 22, 2015

(54) SINGLE-SCREEN MULTIPLE-TIER MOVIE PICTURE THEATER HAVING SEPERATE SERVICE CLASS SECTIONS

(71) Applicant: Enrique Ramirez Magaña, Morelia (MX)

(72) Inventor: Enrique Ramirez Magaña, Morelia (MX)

( * ) Notice: Subject to any disclaimer, the term of this patent is extended or adjusted under 35 U.S.C. 154(b) by 0 days.

(21) Appl. No.: 14/206,268

(22) Filed: Mar. 12, 2014

(65) Prior Publication Data

US 2014/0311046 A1 Oct. 23, 2014

Related U.S. Application Data

(60) Provisional application No. 61/793,455, filed on Mar. 15, 2013.

(51) Int. Cl.
*E04H 3/30* (2006.01)
*E04H 3/22* (2006.01)

(52) U.S. Cl.
CPC ... *E04H 3/30* (2013.01); *E04H 3/22* (2013.01)

(58) Field of Classification Search
CPC ..... E04H 3/30; E04H 3/22
USPC ..... 52/6–10
See application file for complete search history.

(56) References Cited

U.S. PATENT DOCUMENTS

| | | | | | |
|---|---|---|---|---|---|
| 1,957,947 | A * | 5/1934 | Dreyfuss | 52/6 |
| 2,831,217 | A * | 4/1958 | Lombardo | 52/6 |
| 3,469,354 | A * | 9/1969 | Meetze, Jr. | 52/1 |
| 3,545,143 | A * | 12/1970 | Bankston | 52/6 |
| 3,668,810 | A * | 6/1972 | Bankston | 52/6 |
| 4,306,388 | A * | 12/1981 | Yuter | 52/6 |
| 5,459,964 | A * | 10/1995 | Doublet | 52/8 |
| 5,822,928 | A * | 10/1998 | Maxwell et al. | 52/8 |
| 7,617,635 | B2 * | 11/2009 | Jacobs et al. | 52/8 |
| 8,010,906 | B1 * | 8/2011 | Sinnard et al. | 715/771 |
| 8,814,367 | B2 * | 8/2014 | Choi | 353/94 |
| 2003/0131537 | A1 * | 7/2003 | Krikorian et al. | 52/6 |
| 2007/0000185 | A1 * | 1/2007 | DeLine | 52/33 |
| 2009/0241433 | A1 * | 10/2009 | Naito et al. | 52/9 |
| 2011/0302850 | A1 * | 12/2011 | Naito et al. | 52/1 |
| 2012/0297695 | A1 * | 11/2012 | Magpuri | 52/9 |
| 2013/0167452 | A1 * | 7/2013 | Jacques et al. | 52/2.18 |
| 2013/0242263 | A1 * | 9/2013 | Anderson | 352/38 |
| 2014/0230340 | A1 * | 8/2014 | Fox | 52/1 |
| 2014/0235362 | A1 * | 8/2014 | Fox et al. | 472/75 |

* cited by examiner

*Primary Examiner* — Mark Wendell
*Assistant Examiner* — Keith Minter
(74) *Attorney, Agent, or Firm* — Lott & Fischer, PL

(57) ABSTRACT

A mixed-class service multiple-tier theater that allows different patrons attending the same movie to experience differing levels of service depending on how much they wish to pay. There are two tiers for seating. The upper tier would be for regular, stadium style seating, while the lower tier would be for VIP seating with fully reclining seats. The lower and upper tiers are completely separated, each offering its own ingress/egress access, with a balcony overhang from the upper tier cantilevered over the lower tier.

20 Claims, 4 Drawing Sheets

SINGLE-SCREEN MULTIPLE-TIER MOVIE PICTURE THEATER HAVING SEPERATE SERVICE CLASS SECTIONS

This application is being filed as a non-provisional patent application under 35 U.S.C. §111(a) and 37 CFR §1.53(b) claiming priority to provisional application Ser. No. 61/793,455, filed Mar. 15, 2013 the contents of which are incorporated herein by reference.

FIELD OF INVENTION

The invention relates to a movie picture theater, namely, a multiple-tier seating arrangement for a theater which allows for the provision of a distinct level of service to each section.

BACKGROUND OF THE INVENTION

Traditionally, motion pictures have provided inexpensive and accessible entertainment for a large portion of the population worldwide. Until recently, the nature of the product being provided by motion picture theaters is of a one-size-fits-all nature. That is, movie theaters have provided an identical experience to all patrons attending any movie theater or multiplex.

As individual consumer tastes developed, the industry saw the need for a more upscale type of service for patrons that desire better service and are willing to pay additional fees for it. This demand has seen the development of "VIP" (very important person) movie theaters offering the additional, more expensive services. Among these services are included: larger, more comfortable seats; reclining seats; seat-side food service; complete, restaurant-style food and beverage menus; and the like.

The existence of two distinct levels of service has forced patrons and theater operators to make a choice, from the outset, as to what type of service they wish to experience and provide respectively.

At present, there is no mixed-class service that allows different patrons attending the same movie theater to experience differing levels of service depending on how much they wish to pay. Such a mixed-class service is similar to an airline offering a first class cabin and an economy cabin all in the same flight.

The principal reason for this is the fact that in order to provide each class of service, a significantly different configuration of the theater's seating area is needed for each class. The overwhelming majority of movie theaters in the U.S. are single-tiered offering no natural separations that could serve to divide seating areas into differently-configured areas.

Therefore, there is a need in the art for a mixed-class service multiple-tier theater that allows different patrons attending the same movie to experience differing levels of service depending on how much they wish to pay. Further, there is a need in the art for such a theater in which the configuration of the various tiers is optimized to allow for the most convenient, enjoyable and commercially feasible operation possible

SUMMARY OF THE INVENTION

The current invention satisfies the needs in the industry by providing a novel design for a movie picture theater having a single viewing screen that is visible from multiple seating areas, each such area being located on a different vertical level relative to the base of the projection screen. Among the novel aspects of the disclosed theater arrangement is providing different classes of service, based on the seating area, to different patrons attending the same movie presentation. The different service classes offer different levels of comfort, convenience and service, at corresponding price levels, to different classes of patrons without necessitating a different projection screen for each.

In one embodiment, the disclosed movie theater would have three separate tiers. Namely, a lower, middle and an upper tier. The patron seating areas would be located in the lower and upper tiers, while the middle tier would be reserved for a projection room, retail and food shopping space, and other ancillary services.

The lower and upper tiers are completely separated, each offering its own ingress/egress access, with a balcony overhang from the upper tier cantilevered over the lower tier. The middle tier is, in turn, recessed back with respect to both the upper and lower tiers and also has a completely separate access means. The balcony of the upper tier is carefully sized to ensure that it does not block the view of the screen for any patrons located in the lower tier, or projection of the movie onto the screen from the projection room.

Therefore, it is an object of the present invention to provide a mixed-class service multiple-tier theater that allows different patrons attending the same movie to experience differing levels of service depending on how much they wish to pay. In one embodiment, there are two tiers for seating. The upper tier would be for regular, general seating, while the lower tier would be for VIP seating. The lower tier would offer seats that are larger and which recline further than the regular, general seating along with other VIP features, such as food and beverage service.

In one embodiment, the multiple-tier movie picture theater provides different classes of service, based on the seating area, to different patrons attending the same movie. The theater includes a lower tier comprising a VIP seating section, an upper tier comprising a general seating section, and a projector room located near the upper most level of the lower tier. The lower tier is on a floor surface, the projector room is located near the upper most level of the lower tier, and the upper tier comprises a balcony that overhangs the lower tier and projector room. The VIP seating section and the general seating section comprise "stadium" seating where each seating row is elevated with respect to the rows immediately in front of it. The different classes of services offered to the VIP seating section and the general seating section provide different levels of comfort, convenience and service, at corresponding price levels. The class of service provided to the VIP seating section includes: seats that are larger with more space between the seats than those of the general seating section, seats which recline further than those of the general seating section, additional leg and aisle room, and food and beverage service. The upper and lower tiers and the projector room each have separate ingress and egress means.

These and other objects, features, and advantages of the present invention may be better understood and appreciated from the following detailed description of the embodiments thereof, selected for purposes of illustration and shown in the accompanying drawings.

DETAILED DESCRIPTION OF THE INVENTION

Figure 1:
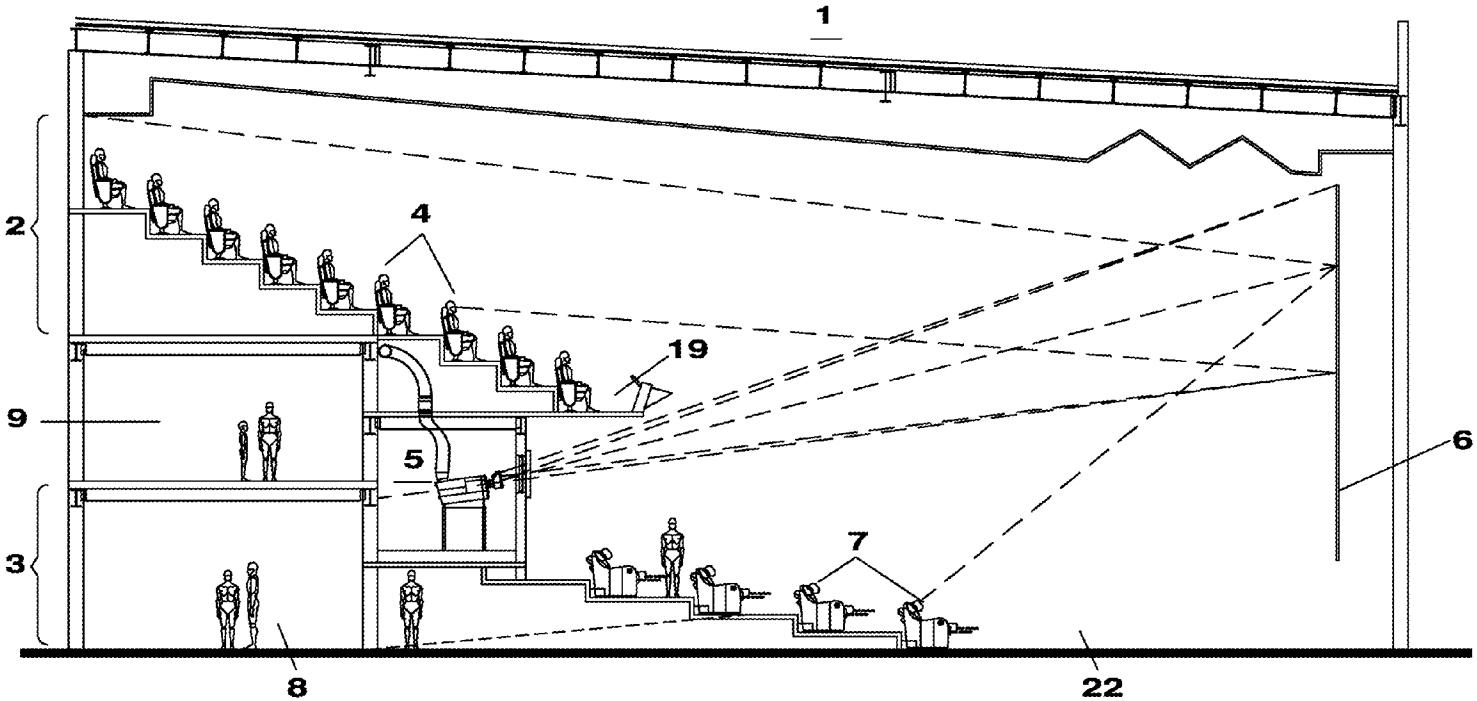
FIG. 1 is an elevational view of the multiple-tier movie picture theater.

Embodiments of the invention are illustrated in the accompanying drawings. FIG. 1 is an elevational view of the multiple-tier movie picture theater 1. The lower tier 3 and upper tier 2 are completely separated, each offering its own ingress/egress access, with a balcony 19 overhang from the upper tier 2 cantilevered over the lower tier 3. There is a separate access area 8 to the lower tier as well as a hall 9 for ingress/egress to the lower tier 3. The projector room 5 is located between the tiers and recessed back with respect to both the upper 2 and lower 3 tiers and also has a completely separate access means. Accordingly, the projector room 5 may also be referred to herein as a middle tier, which is between the upper tier 2 and the lower tier 3. The balcony 19 of the upper tier 2 is carefully sized to ensure that it does not block the view of the screen 6 for any patrons located in the lower tier 3, or projection of the movie onto the screen 6 from the centrally located and recessed projection room 5.

As shown in the attached illustrations, the upper tier 2 and lower tier 3 would provide for "stadium" seating where each seating row is elevated with respect to the rows immediately in front of it. However, as shown, each tier's respective seating area has a different row pitch and angle of inclination relative to the ground level. This allows for each seat in the VIP seating area of the lower tier 3 to be larger and to have more room.

The upper tier 2 includes seating rows 4 that are smaller and closer together than the lower tier 3 or VIP section. In one embodiment, the upper tier 2 has a row pitch of 1.15 m. (45.27 in.) and each row 4 is elevated by 0.51 m (20.08 in) with respect to the row 4 immediately in front of it, yielding an approximate angle of inclination of 23.9 degrees. In contrast, the lower tier 3 of the same embodiment has a row 7 pitch of 2.10 m. (82.68 in.) and each row 7 is elevated by 0.35 m (13.78 in) with respect to the row 7 immediately in front of it, yielding an approximate angle of inclination of 9.5 degrees.

The variation in row pitch between the upper 2 and lower 3 tiers permits the use of larger, and more comfortable seat assemblies, in connection with the lower tier 3 or VIP section of the theater. The larger row pitch is also required because an important feature of the VIP section of the theater 1 is that it permits the seats to recline to an almost horizontal position section which also requires the greater row pitch. Of course, the use of a greater row pitch eliminates the need of additional elevation from row to row in order to achieve obstructed views.

As will be noted, the use of extreme reclining seats in the VIP section of the theater requires that the VIP seating section be located in the lower tier 3 of the theater. Otherwise, the viewing angle for a patron in the fully reclined position would be such that the screen 6 view would be obstructed by the patron's own feet and would be at an uncomfortably low viewing angle providing for a less-than-optimal experience.

It is anticipated that in combination with the novel theater arrangement described herein and in the accompanying illustrations, it will be advantageous to use a novel theater seat design, such as that described in U.S. patent application Ser. No. 14/164,992 filed on Jan. 27, 2014 by the Applicant.

Figure 2:
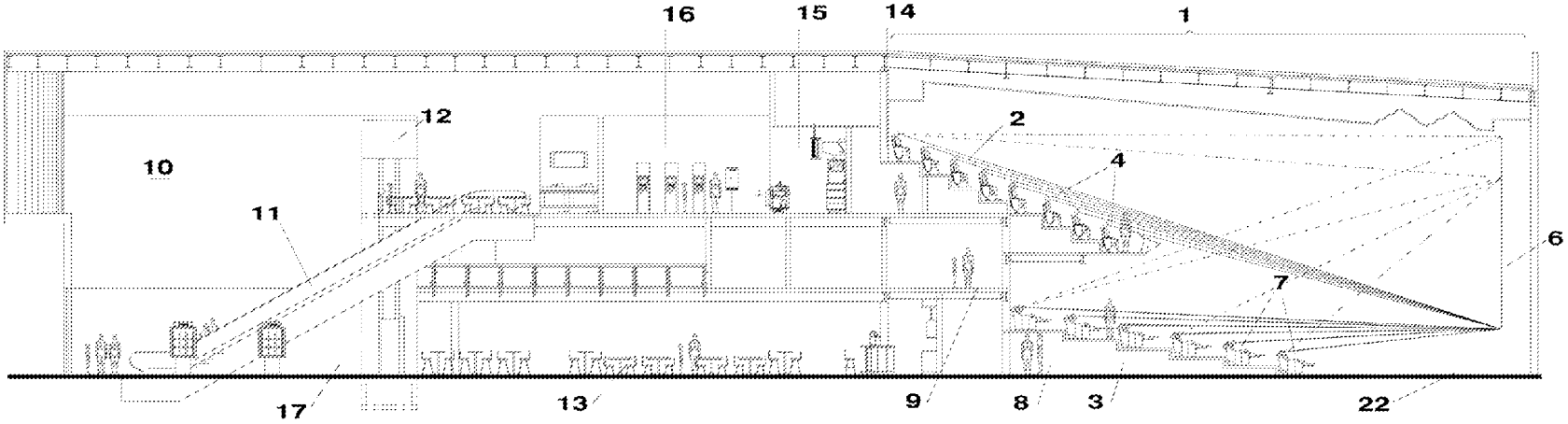
FIG. 2 is an elevational view of the multiple-tier movie picture theater and lobby.

FIG. 2 is an elevational view of the multiple-tier movie picture theater 1 and lobby 10. The patrons enter the establishment into a main lobby 10. Patrons who wish to sit in the general seating or upper tier 2 are directed up the escalator 11 or elevator 12 to the third floor. The third floor includes a stadium lobby 16 with a concession area 15 and a food preparation area 14. Access 18 to the upper tier 2 is also found on the third floor and may include a stairway leading up into the upper tier 2. Patrons who wish to sit in the lower tier 3 can enter directly through the VIP or lower tier entrance 17 on the first floor. The lower tier entrance 17 may require that the patron submit a ticket, either electronically or in paper form, before passing the entrance 17. The first floor also includes a seating or dining area 13 and may further include a bar. The first floor also includes the lower tier access 8, which can be stairs, steps or aisle ways leading into the lower tier 3. VIP patrons may also use the second floor as a lounge and hall 9, which would also be accessible by the lower tier access 8 stairs leading to the lower tier 3.

Figure 3:
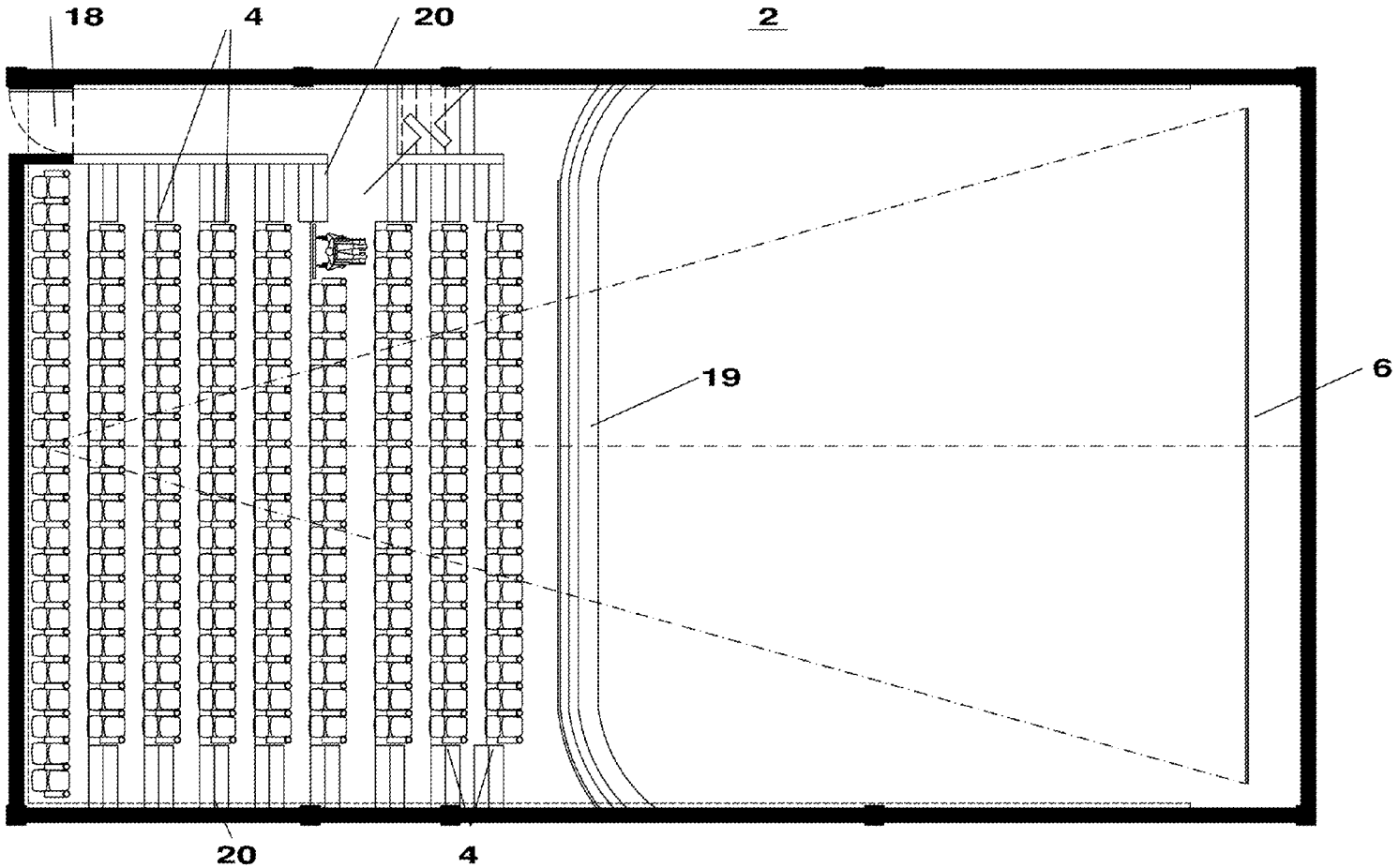
FIG. 3 is a top view of the upper tier of the theater.

FIG. 3 is a top view of the upper tier 2 of the theater 1. The upper tier 2 is designed for general seating. The upper tier 2 is accessed by entrance 18, which may include steps or stairs. Aisles 20 are found on either side of the upper tier 2 for accessing the seating rows 4. A balcony 19 is at the front of the upper tier 2. The screen 6 is viewable from every seat in the upper tier 2. In the embodiment of FIG. 3, 164 seats are able to fit within the upper tier 2. As shown, the upper tier 2 comprises a balcony 19 and the upper tier 2 is approximately half of the size of the theater 1 leaving the space nearest a screen 6 open to the lower tier 3 below.

Figure 4:
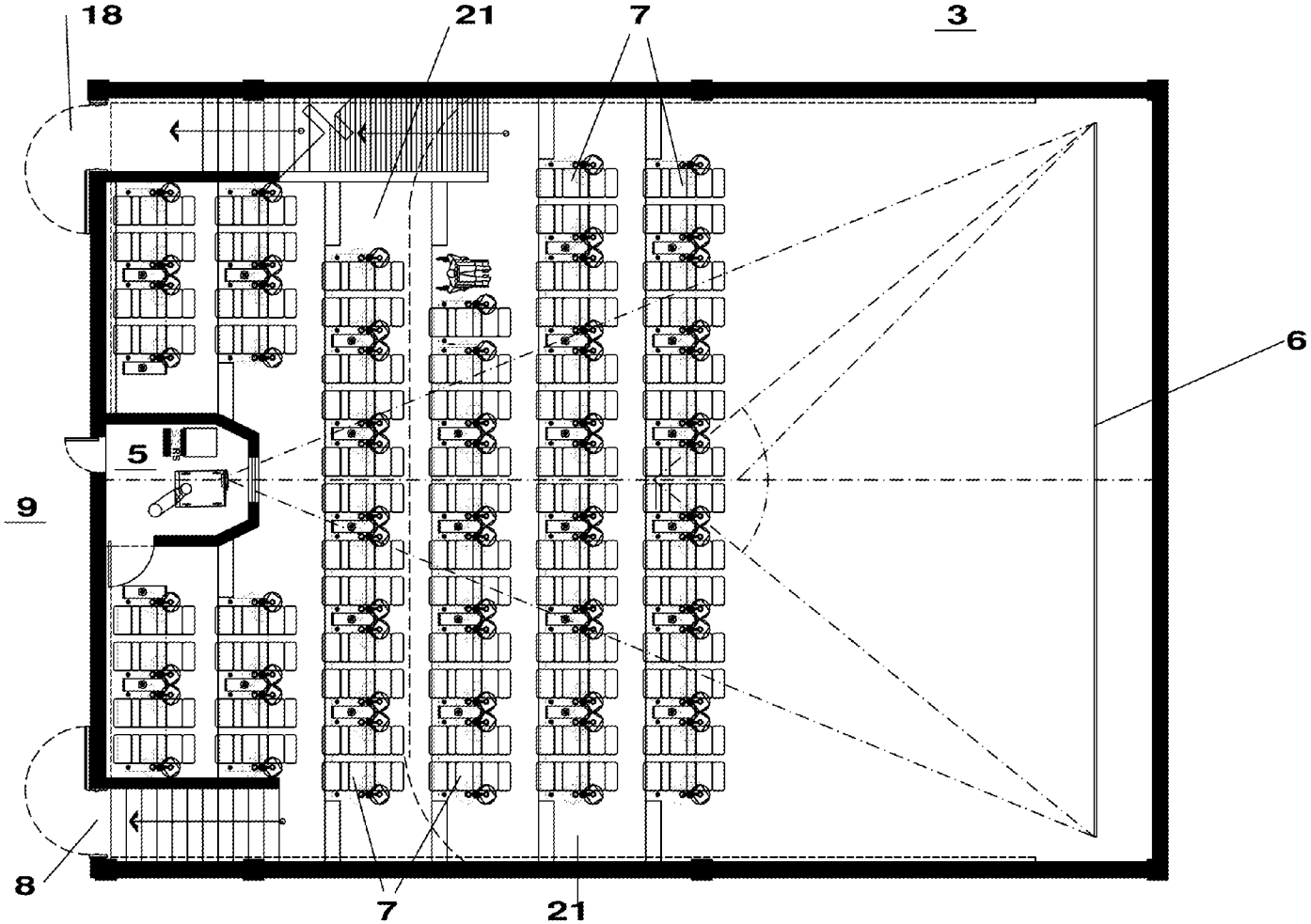
FIG. 4 is top view of the lower tier of the theater.

FIG. 4 is a top view of the lower tier 3 of the theater 1. The lower tier 3 will be most often used as the VIP area of the theater 1. The lower tier 3 will be accessible from entrance 8, which may include steps or stairs. The entrance 8 will lead into an aisle 21 for accessing the seating rows 7. Another aisle 21 is located on the other side of the seating rows 7. There is a VIP hall 9 or lounge area just outside of the lower tier 3. The projection room 5 is located at the upper most level of the lower tier 3 and has seating rows 7 on either side of it. In the embodiment shown in FIG. 4, 68 VIP seats are able to fit within the lower tier 3. The VIP seating section fills approximately three-fourths of the theater floor space 22 leaving the floor space 22 in front of the screen 6 void of seats. As shown in FIGS. 3 and 4, the seats within the lower tier 3 are larger and have additional room in comparison to the seats in the upper tier 2.

Referring to FIG. 1, in one embodiment of the invention, the multiple-tier movie picture theater 1 comprises a horizontal floor surface 22 having a front and a rear end and a screen 6 for projection of the movie picture. The screen 6 is disposed at the front of the floor surface 22 and is substantially perpendicular to the floor surface 22. A lower tier 3 seating area is located directly above the floor surface 22. The lower tier 3 seating area further comprises lower tier seating rows 7 disposed from front to back of the lower tier 3 seating area, wherein the elevation of each of the lower tier seating rows 7 increases with respect to the lower tier seating row 7 directly in front of it. The arrangement resulting is a lower tier seating row 7 pitch and a lower tier seating area inclination angle.

There is also a projector room 5 or middle tier area adapted to accommodate a projector for projecting a movie picture upon the screen 6. The lowest part of the middle tier being located above the base of the rearmost lower tier seating row 7. The projector room 5 may be located between the upper most seating rows 7 of the lower tier 3. An upper tier 2 seating area is located directly above the highest part of the middle tier or projector room 5. The upper tier 2 seating area further comprises upper tier seating rows 4 disposed from front to back of the upper tier 2 seating area, wherein the elevation of each of the upper tier seating rows 4 increases with respect to the upper tier seating row 4 directly in front of it. The arrangement resulting is an upper tier seating row 4 pitch and an upper tier seating area inclination angle.

The upper tier 2 and the lower tier 3 are disposed relative to each other so as to permit unobstructed views of the screen 6 by any person seated in the lower tier 3. The upper tier 2 and the middle tier or projector room 5 are disposed relative to each other so as to permit the unobstructed projection of the movie picture on the screen 6 by a projector located in the middle tier or projector room 5. The lower tier seating row 7 pitch is greater than the upper tier seating row 4 pitch. The lower tier 3 seating area inclination angle is smaller than the upper tier 2 seating area inclination angle. The lower tier 3 seating area, the middle tier or projector room 5, and the upper tier 2 seating area each have separate ingress and egress means 8, 18.

Although the invention is illustrated in detail in the accompanying figures and examples and described herein, various modifications and structural changes may be made therein without departing from the spirit of the invention and within the scope and range of equivalents of the disclosed designs. For example, it is anticipated that the present invention can be applied not only to auditoriums for projected movies, but also for those adapted for live performances.

What is claimed is:

1. An auditorium for movie picture presentations comprising:

a. A horizontal floor surface having a front and a rear end;

b. A screen for projection of said movie picture, said screen being disposed at the front of said floor surface, said screen being substantially perpendicular to said floor surface;

c. A lower tier seating area located directly above said floor surface, said lower tier seating area further comprising lower tier seating rows disposed from front to back of said lower tier seating area, wherein the elevation of each of said lower tier seating rows increases with respect to the lower tier seating row directly in front of it, and wherein the distance between adjacent lower tier seating rows comprises a lower tier seating row pitch;

d. A middle tier area adapted to accommodate a projector for projecting a moving picture upon said screen, the lowest part of said middle tier being located above the base of the rearmost lower tier seating row;

e. An upper tier seating area located directly above the highest part of said middle tier, said upper tier seating area further comprising upper tier seating rows disposed from front to back of said upper tier seating area, wherein the elevation of each of said upper tier seating rows increases with respect to the upper tier seating row directly in front of it, and wherein the distance between adjacent upper tier rows comprises an upper tier seating row pitch;

f. Wherein said upper tier and said lower tier are disposed relative to each other so as to permit unobstructed views of said screen by any person seated in said lower tier;

g. Wherein said upper tier and said middle tier are disposed relative to each other so as to permit the unobstructed projection of said movie picture on said screen by a projector located in said middle tier;

h. Wherein said lower tier seating row pitch is greater than said upper tier seating row pitch;

i. Wherein said lower tier seating area, said middle tier, and said upper tier seating area each have separate ingress and egress means.

2. A multiple-tier movie picture theater comprising:

a. A lower tier seating area with seating rows and reclining seats disposed within said rows;

b. An upper tier seating area with seating rows, and reclining seats disposed within said rows, wherein the upper tier seating area is located above the lower tier seating area;

c. Wherein said lower tier seats recline further back than said upper tier seats:

d. A projector room located below the upper tier, and e. Wherein the lower tier and upper tier seating rows comprise stadium seating where each seating row is elevated with respect to the rows immediately in front of it.

3. The multiple-tier movie picture theater of claim 2, wherein the upper tier and the lower tier are disposed relative to each other so as to permit unobstructed views of a screen by any person seated in the upper or lower tier.

4. The multiple-tier movie picture theater of claim 2, wherein the lower tier seating rows fill approximately three-fourths of a theater floor space leaving the floor space in front of a screen void of seats.

5. The multiple-tier movie picture theater of claim 2, wherein the upper tier comprises a balcony and the upper tier is approximately half of the length of the theater leaving the space nearest a screen open to the lower tier below.

6. The multiple-tier movie picture theater of claim 2, wherein the projector room is located near the upper most level of the lower tier and has lower tier seating rows on either side of it.

7. The multiple-tier movie picture theater of claim 2, where in the upper and lower tiers have separate ingress and egress means.

8. The multiple-tier movie picture theater of claim 2, wherein the projector room has a separate ingress and egress means.

9. The multiple-tier movie picture theater of claim 2, wherein the lower and upper tier offer distinct, separate services.

10. The multiple-tier movie picture theater of claim 2, wherein the upper tier seating area comprises seats that are smaller and closer together than the seats of the lower tier.

11. The multiple-tier movie picture theater of claim 2, wherein the lower tier contains larger seats than the upper tier.

12. A multiple-tier movie picture theater providing different classes of service, based on the seating area, to different patrons attending the same movie comprising:

a. A lower tier comprising a seating section providing a first class of service;

b. An upper tier comprising a seating section providing a second class of service;

c. Wherein the upper tier seating section and the lower tier seating section each comprise stadium seating where each seating row is elevated with respect to the rows immediately in front of it;

d. Wherein the first and second classes of service provide different levels of comfort, convenience and service, at corresponding price levels, based upon selection of the upper tier or lower tier seating sections; and e. Wherein seats in said lower tier seating section are adapted to recline further back than seats in said upper tier seating section.

13. The multiple-tier movie picture theater of claim 12, wherein the lower tier seating section includes at least one of the following: seats that are larger than the seats in the upper tier seating section; and a great amount of space between the seats than that provided in the upper tier seating section.

14. The multiple-tier movie picture theater of claim 12, further including a projector room located near the upper most level of the lower tier.

15. The multiple-tier movie picture theater of claim 12, wherein the upper tier and the lower tier are disposed relative to each other so as to permit unobstructed views of the screen by any person seated in the upper or lower tier.

16. The multiple-tier movie picture theater of claim 12, wherein the upper and lower tiers have separate ingress and egress means.

17. The multiple-tier movie picture theater of claim 14, wherein the projector room has a separate ingress and egress means.

18. The multiple-tier movie picture theater of claim 12, wherein the lower tier seating section fills approximately three-fourths of a theater floor space leaving the floor space in front of a screen void of seats.

19. The multiple-tier movie picture theater of claim 12, wherein the upper tier comprises a balcony and the upper tier is approximately half of the size of the theater leaving the space nearest a screen open to the lower tier below.

20. A multiple-tier movie picture theater providing different classes of service, based on the seating area, to different patrons attending the same movie comprising:

a. A lower tier comprising a seating section providing a first class of service;

b. An upper tier comprising a seating section providing a second class of service;

c. A projector room located in the upper most level of the lower tier and recessed to the back of the lower tier;

d. Wherein the lower tier is on a floor surface, the projector room is located near the upper most level of the lower tier, and the upper tier is above the lower tier and projector room and comprises a balcony that overhangs the lower tier and projector room;

e. Wherein the upper tier seating section and the lower tier seating section each comprise stadium seating where each seating row is elevated with respect to the rows immediately in front of it;

f. Wherein the first and second classes of service provide different levels of comfort, convenience and service, at corresponding price levels, based upon selection of the upper tier and lower tier seating sections;

g. Wherein the lower tier seating section includes at least one of the following: seats that are larger than the seats in the upper tier seating section; and a greater amount of space between the seats than that provided in the upper tier seating section;

h. Wherein the lower tier seating section includes at least one of the following: seats that are larger than the seats in the upper tier seating section; a greater amount of space between the seats than that provided in the upper tier seating section; and seats that are adapted to recline further than those of the upper tier seating section; and i. Wherein the upper and lower tier seating sections and the projector room each have separate ingress and egress means.

* * * * *